US007639201B2

(12) United States Patent
Marklein et al.

(10) Patent No.: US 7,639,201 B2
(45) Date of Patent: Dec. 29, 2009

(54) ULTRA WIDEBAND LOOP ANTENNA

(75) Inventors: Eric Marklein, Amherst, MA (US); Daniel Schaubert, Amherst, MA (US)

(73) Assignee: University of Massachusetts, Boston, MA (US)

( * ) Notice: Subject to any disclaimer, the term of this patent is extended or adjusted under 35 U.S.C. 154(b) by 0 days.

(21) Appl. No.: 12/015,701

(22) Filed: Jan. 17, 2008

(65) Prior Publication Data

US 2009/0184880 A1 Jul. 23, 2009

(51) Int. Cl.
*H01Q 1/14* (2006.01)

(52) U.S. Cl. ..... 343/866; 343/700 MS

(58) Field of Classification Search ..... 343/700 MS, 343/866, 741

See application file for complete search history.

(56) References Cited

U.S. PATENT DOCUMENTS

| | | | | |
|---|---|---|---|---|
| 3,015,101 | A | 12/1961 | Turner et al. | |
| 6,437,756 | B1 | 8/2002 | Schantz | |
| 6,590,541 | B1 * | 7/2003 | Schultze | 343/741 |
| 6,590,545 | B2 | 7/2003 | McCorkle | |
| 6,593,886 | B2 | 7/2003 | Schantz | |
| 6,914,573 | B1 | 7/2005 | McCorkle | |
| 7,061,442 | B1 | 6/2006 | Tang et al. | |
| 7,132,985 | B2 | 11/2006 | Lin | |
| 7,187,329 | B2 | 3/2007 | Okado | |
| 7,262,741 | B2 | 8/2007 | Krupezevic et al. | |
| 7,307,588 | B2 | 12/2007 | Tseng | |
| 2005/0280582 | A1 | 12/2005 | Powell et al. | |
| 2007/0285332 | A1 | 12/2007 | Sarabandi et al. | |

FOREIGN PATENT DOCUMENTS

EP 18112988 A2 8/2007

OTHER PUBLICATIONS

Tanaka, S., et al., "Wideband and compact folded loop antenna"; Electronics Letters, Aug. 18, 2005, vol. 41, No. 17.

Tavassolian, Negar, et al., "Microwave Tumor Detection Using a Flexible UWB Elliptical Slot Antenna with a Tuning Uneven U-shape Stub on LCP"; 1-4244-0878-4/07, 2007 IEEE.

Schantz, Hans Gregory, "UWB Magnetic Antennas"; 0-7803-7846-6/03, 2003 IEEE.

Farr, Everett G., et al, "A Two-Channel Balanced-Diple Antenna (BDA) with Reversible Antenna Pattern Operating at 50 Ohms"; Sensor and Simulation Notes, Note 441 Dec. 1999.

* cited by examiner

*Primary Examiner*—HoangAnh T Le
(74) *Attorney, Agent, or Firm*—Brian M. Dingman; Mirick, O'Connell, DeMallie & Lougee, LLP

(57) ABSTRACT

An ultra wideband loop antenna having a planar antenna element defining an at least semi-elliptical perimeter having a major axis, a minor axis and a center. There is also an elongated, contiguous discontinuity in the antenna element that is symmetric about the antenna element minor axis, entirely located within the antenna element, and defining a discontinuity feed end located on the minor axis and spaced from one side of the antenna element perimeter by an element feed width, and further defining an opposed discontinuity ground end located on the minor axis and spaced from the opposing side of the antenna element perimeter by an element ground width, to define an antenna element ground portion, wherein the feed width is greater than the ground width. The antenna also has a feed region connecting the feed end of the discontinuity to the perimeter, to define antenna element feed ends that are adjacent to the feed region.

17 Claims, 18 Drawing Sheets

Fig. 8A
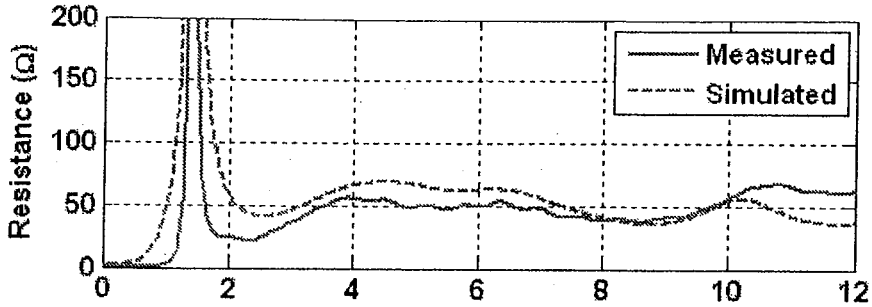
Fig. 8B
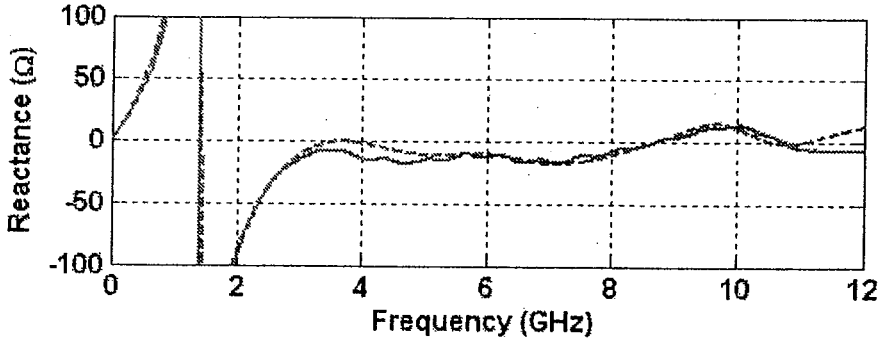
Fig. 9A
Fig. 9B
Fig. 9C
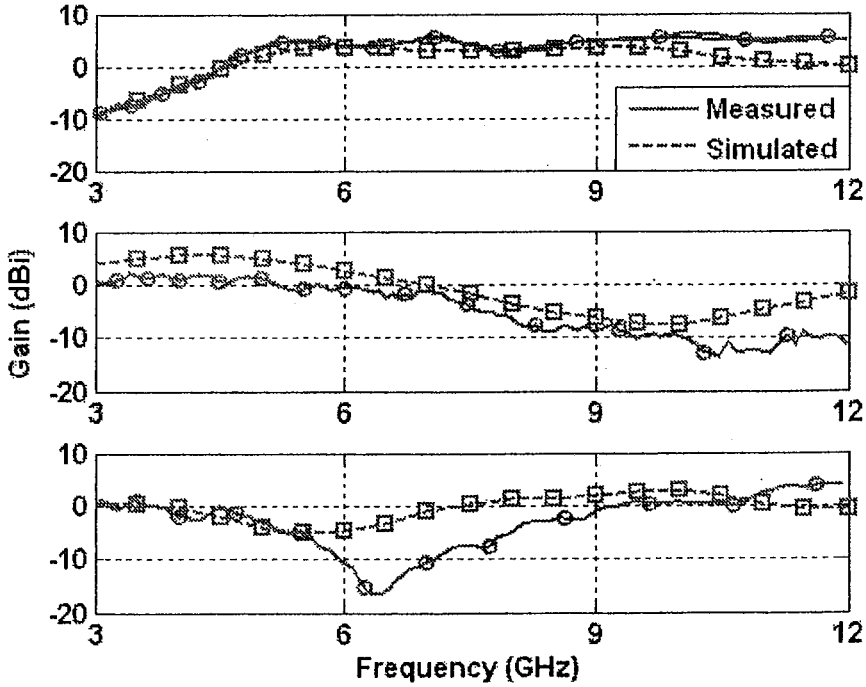

$E_\theta(\theta, \Phi=0°)$

3 GHz

6 GHz

8 GHz

10 GHz $E_\Phi(\theta, \Phi=0°)$

3 GHz

6 GHz

8 GHz

10 GHz $E_\Phi$ ($\theta$, $\Phi$=90°)

3 GHz

6 GHz

8 GHz

10 GHz

ULTRA WIDEBAND LOOP ANTENNA

GOVERNMENT RIGHTS

This invention was made with Government support under US Army Research Office grant contract number DAAD19-01-1-0477. The Government has certain rights in the invention.

FIELD OF THE INVENTION

This invention relates to an ultra wideband loop antenna.

BACKGROUND OF THE INVENTION

Ultra wideband (UWB) antennas should operate across a bandwidth of at least about 1.5:1 [or 20% at the center frequency, according to the FCC standards] at microwave frequencies; one being from 3.1-10.6 GHz. The antenna should exhibit a reasonably stable input resistance and reactance across the frequency range to accomplish a voltage standing wave ratio (VSWR) lower than two across the antenna's average resistance.

Ultra wideband loop antennas are typically embodied as either a half loop driven against an orthogonal ground plane, or a full loop. Such antennas typically have a feed region that is much narrower than the ground region. Examples are found in U.S. Pat. No. 3,015,101 to Turner et al., U.S. Pat. No. 6,437,756 to Schantz, U.S. Pat. No. 6,914,573 to McCorkle, U.S. Pat. No. 7,132,985 to Lin, and U.S. Pat. No. 7,262,741 to Krupezevic at al. Such antennas are typically modified loops having an elliptical shape with a number of resonances that help to accomplish ultra wideband performance. However, modified loop antennas sometimes have a characteristic impedance that is too high for many applications. Another problem with such antennas is that the impedance may not be stable across the operating range. Also, these antennas can suffer from problematic spatial variation in the radiation pattern as a function of frequency.

SUMMARY OF THE INVENTION

It is therefore an object of this invention to provide a loop antenna that can be embodied as either a half loop over a ground plane, or a full loop.

It is a further object of this invention to provide such an antenna that has a more stable impedance across a wider bandwidth that some other loop antennas.

It is a further object of this invention to provide such an antenna that can be designed to have a desired characteristic impedance that matches the system with which it is used.

The inventive UWB loop antenna has a wide feed region and a narrow ground region; typically the width ratio of the two regions is at least about 5:1, and can approach 10:1 or greater. The feed to ground width ratio accomplishes a lower impedance across a wide frequency band as compared to prior art loop antennas with feed widths that are equal to, and in most cases much less than, the ground width. The prior art does not suggest a feed width that is substantially greater than the ground width. The invention is thus an appropriate passive or active antenna for a wider range of UWB systems that require lower impedances, often in the range of 50 Ohms.

This invention features an ultra wideband loop antenna comprising a planar antenna element defining an at least semi-elliptical perimeter having a major axis, a minor axis and a center, and an elongated, contiguous discontinuity in the antenna element that is symmetric about the antenna element minor axis, entirely located within the antenna element, and defining a discontinuity feed end located on the minor axis and spaced from one side of the antenna element perimeter by an element feed width, and further defining an opposed discontinuity ground end located on the minor axis and spaced from the opposing side of the antenna element perimeter by an element ground width, to define an antenna element ground portion, wherein the feed width is greater than the ground width, and a feed region connecting the feed end of the discontinuity to the perimeter, to define antenna element feed ends that are adjacent to the feed region. The antenna element may define an essentially fully elliptical perimeter to accomplish a full loop antenna. Alternatively, the antenna element may define an essentially semi-elliptical perimeter, and the antenna may further comprise a ground plane element oriented in a plane that is orthogonal to the antenna element, in which the antenna element ground portion is electrically coupled to the ground plane, to accomplish a half loop antenna.

In one embodiment the antenna element is a planar conductor. The conductor may be on the surface of a dielectric member. The dielectric member may be of greater area than the antenna element, and extend beyond the element perimeter around at least most of the perimeter. One or more portions of the antenna element planar conductor may be removed.

In another embodiment the ultra wideband loop antenna comprises a planar dielectric member with a planar conductor on its surface, and the antenna element comprises a gap in the conductor, and both the discontinuity in the antenna element and the feed region comprise portions of the planar conductor.

The discontinuity may define a generally elliptical perimeter having a major axis, a minor axis and a center, in which the centers of the two ellipses are not coincident. The major axis of the discontinuity may be parallel to and spaced from the antenna element minor axis by an offset height. The offset height may be greater than the minor radius of the discontinuity ellipse. The two halves of the antenna element that are defined by its minor axis may be separated by an offset height, and the two halves of the discontinuity that are defined by its major axis may be separated by the same offset height.

The feed width is preferably at least about five times greater than the ground width. The antenna element feed ends are preferably essentially identical to one another. The antenna element feed ends may for example define a smoothly curved bulbous shape, or may define a gently tapered shape. The antenna element major axis is preferably longer than its minor axis. The antenna element major axis is preferably less than about twice as long as its minor axis.

In a more specific embodiment, the invention features an ultra wideband loop antenna comprising a planar conductive antenna element defining an essentially elliptical perimeter having a major axis, a minor axis and a center, in which the antenna element major axis is longer than its minor axis but is less than about twice as long as its minor axis, and in which the two halves of the antenna element that are defined by its minor axis are separated by an offset height, an elongated, contiguous gap in the antenna element that is symmetric about the antenna element minor axis, entirely located within the antenna element, and defines a generally elliptical perimeter having a major axis, a minor axis and a center, the major axis of the gap being parallel to and spaced from the antenna element minor axis by the offset height, wherein the offset height is greater than the minor radius of the gap ellipse, the gap defining a gap feed end located on the minor axis and spaced from one side of the antenna element perimeter by an element feed width, and further defining an opposed gap ground end located on the minor axis and spaced from the opposing side of the antenna element perimeter by an element ground width, to define an antenna element ground portion, wherein the feed width is at least about five times greater than the ground width, and a feed region connecting the feed end of the gap to the perimeter, to define antenna element feed ends that are adjacent to the feed region, the antenna element feed ends being essentially identical to one another.

In another more specific embodiment, the invention features an ultra wideband loop antenna comprising a planar conductive antenna element defining an essentially semi-elliptical perimeter having a major axis, a minor axis and a center, in which the antenna element major axis is longer than its minor axis but is less than about twice as long as its minor axis, an elongated, contiguous gap in the antenna element that is symmetric about the antenna element minor axis, entirely located within the antenna element, and defines a generally semi-elliptical perimeter having a major axis, a minor axis and a center, the major axis of the gap being parallel to and spaced from the antenna element minor axis by an offset height that is greater than the minor radius of the gap ellipse, the gap defining a gap feed end located on the minor axis and spaced from one side of the antenna element perimeter by an element feed width, and further defining an opposed gap ground end located on the minor axis and spaced from the opposing side of the antenna element perimeter by an element ground width, to define an antenna element ground portion, wherein the feed width is at least about five times greater than the ground width, a feed region connecting the feed end of the gap to the perimeter, to define antenna element feed ends that are adjacent to the feed region, the antenna element feed ends being essentially identical to one another, and a ground plane element oriented in a plane that is orthogonal to the antenna element, in which the antenna element ground portion is electrically coupled to the ground plane.

BRIEF DESCRIPTION OF THE DRAWINGS

Other objects, features and advantages will occur to those skilled in the art from the following description of the preferred embodiments and the accompanying drawings, in which:

FIGS. 8A and 8B show tested and simulated impedance measurements of a half loop antenna of the invention;

FIGS. 9A, 9B and 9C show the measured and simulated gain of the preferred embodiment of the half loop and full loop inventive antenna at $E_\theta$ ($\theta$=0°, $\Phi$=0°), $E_\Phi$ ($\theta$=90°, $\Phi$=0°) and $E_\Phi$ ($\theta$=45°, $\Phi$=90°), respectively, over the operating frequency.

DETAILED DESCRIPTION OF PREFERRED EMBODIMENTS

Figure 1A:
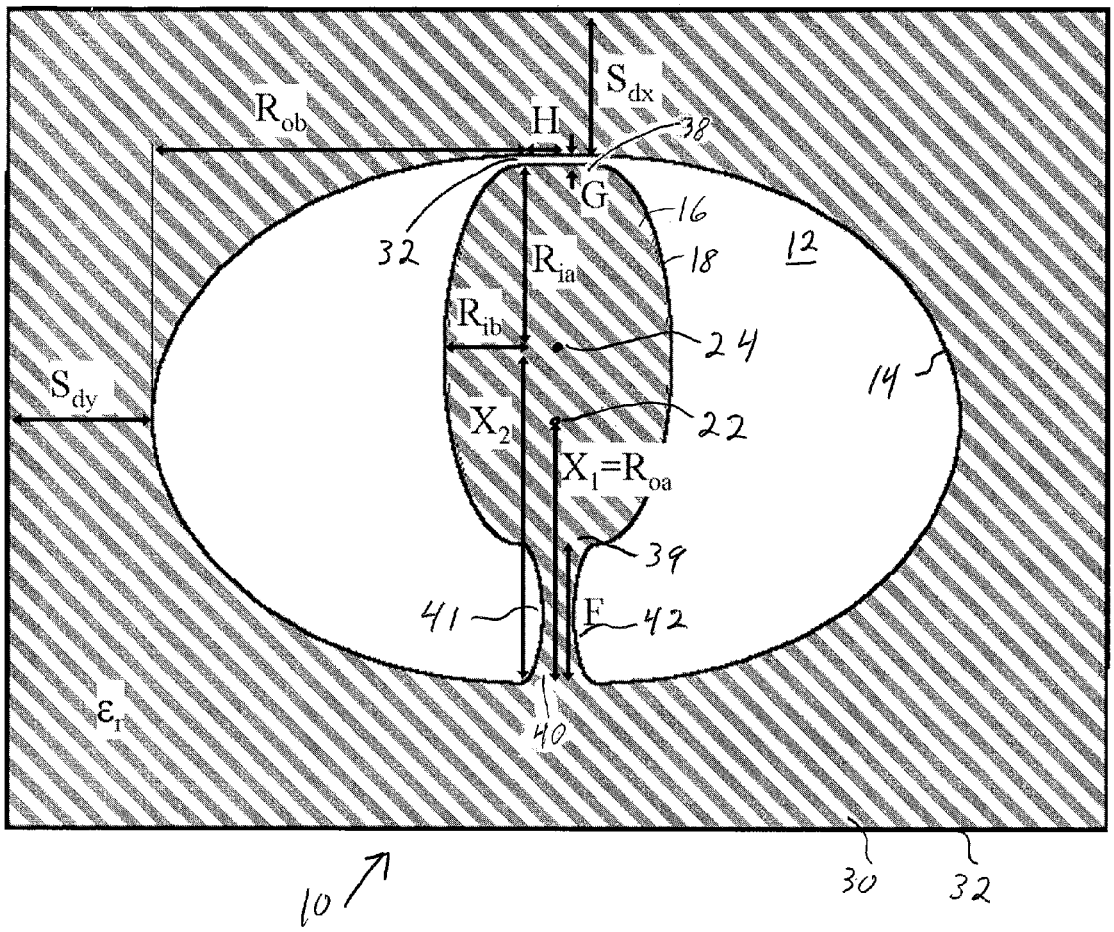
FIG. 1A is a plan view of the preferred embodiment of the full loop antenna of the invention, also illustrating the various antenna parameters described below.

The invention may be accomplished in either a full loop or half loop antenna. The general shape of the embodiment of the inventive full loop antenna, FIG. 1A, is a large outer ellipse with a much smaller ellipse inside. The antenna is symmetric about the vertical (y) axis. The antenna is preferably accomplished with a planar conductor supported on a substrate; the substrate is shown in cross-hatching in FIG. 1A. Alternatively, the cross-hatched regions can comprise the conductor, in which case the large ellipse comprises an area from which the conductor has been removed; an example is shown in FIG. 1C.

Figure 1B:
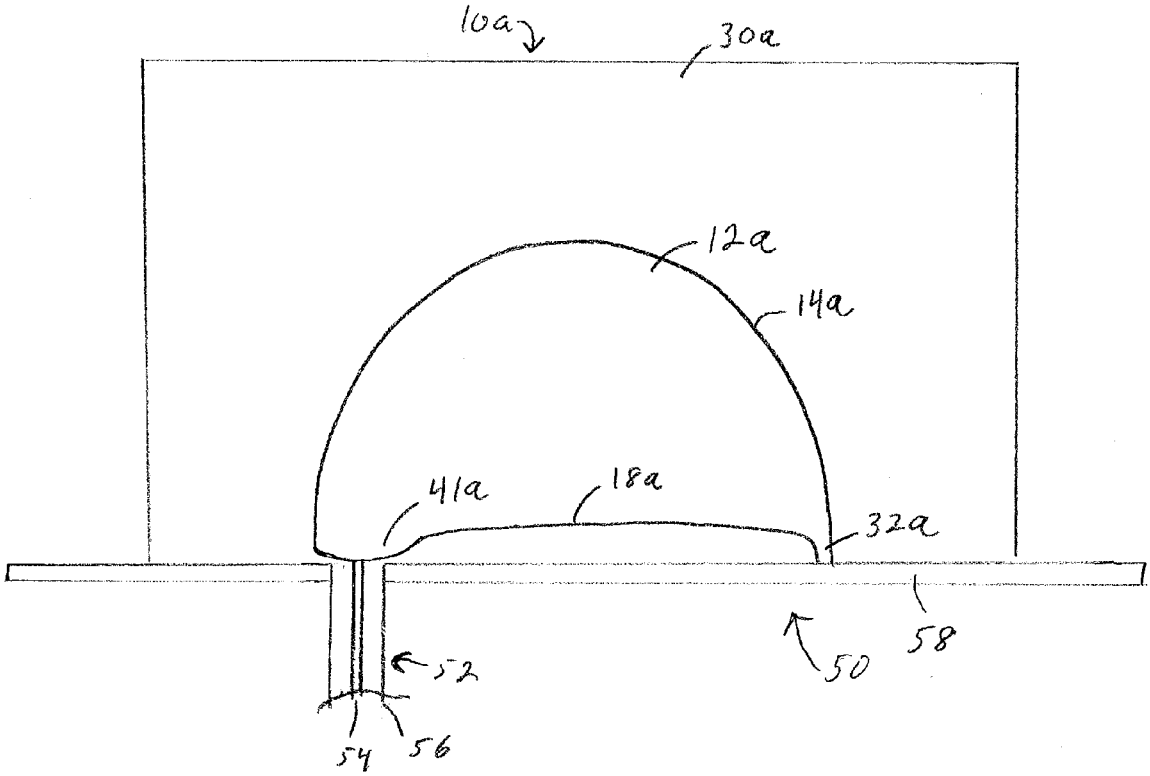
FIG. 1B is a view of the preferred embodiment of the half loop antenna of the invention.
Figure 1C:
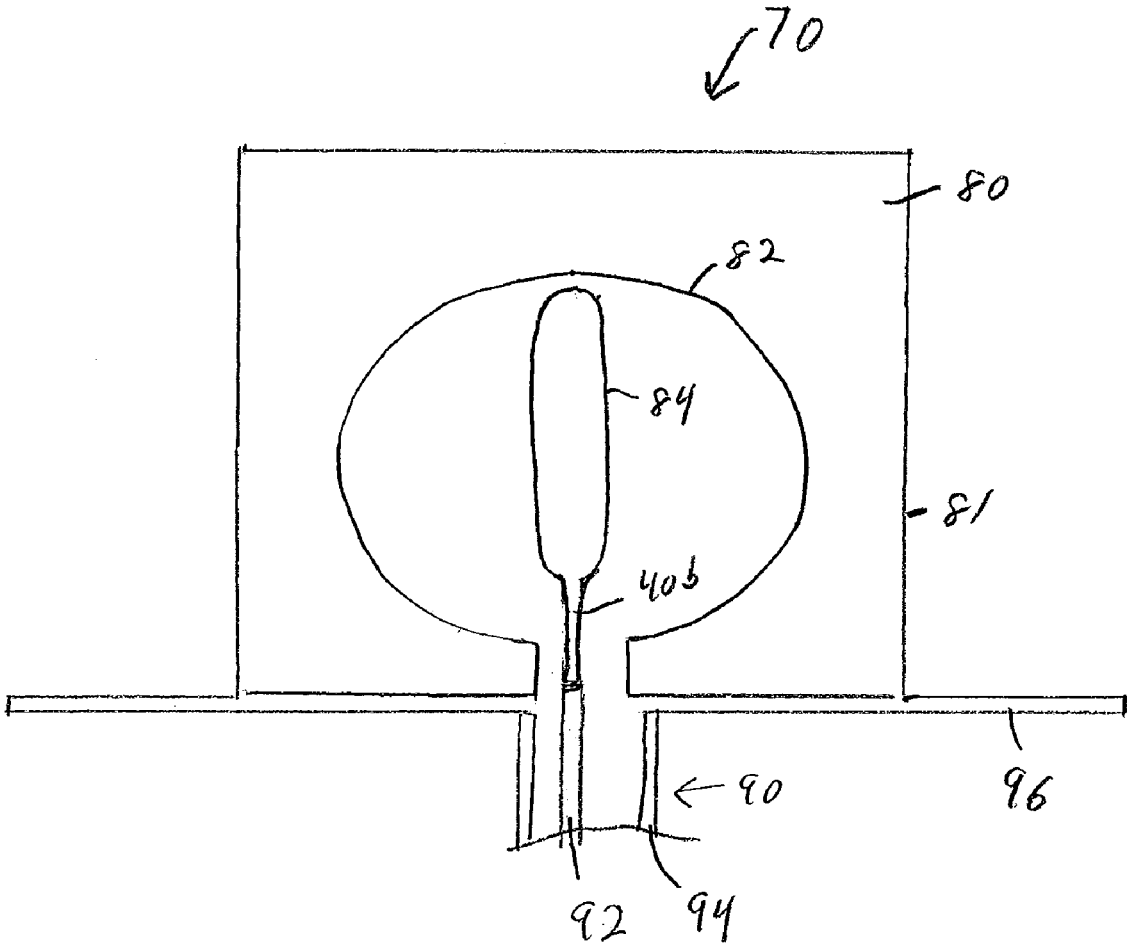
FIG. 1C is a view of an alternative embodiment of the loop antenna of the invention.

The embodiment of the half loop antenna, FIG. 1B, comprises one half of the full loop over an orthogonal ground plane, with the ground region of the loop electrically coupled to the ground plane.

The feed ends of the antenna are preferably bulbous or triangular, and wide. Unlike prior art ultra wideband antennas, the inventive antenna features a wide feed end and very narrow ground portion, whereas the prior art antennas have a wide ground portion that is at least as wide as, and in most cases much wider than, the feed end. The inventive loop antenna can be accomplished with or without a dielectric substrate backing and still achieve wide bandwidth, although the use of a dielectric will allow the antenna to achieve lower characteristic impedance matching. The inventive antenna can also be used as a half-loop over a ground plane.

The following describes embodiments of the inventive antenna, and how varying several of the antenna parameters affect the antenna's bandwidth performance.

FIG. 1A shows an embodiment of the inventive full loop UWB loop antenna 10. Full loop antenna 10 comprises a planar conductor antenna element 12 that is on the surface of an FR-4 (dielectric) substrate 30 (crosshatched in the drawing) having perimeter 32. Substrate 30 has a thickness of 62 mils in one non-limiting embodiment. The large elliptical perimeter 14 is characterized in the preferred embodiment by an outer radius width $R_{oa}$ of 14.5 mm, and an outer radius height $R_{ob}$ of 19 mm. Smaller inner elliptical discontinuity 16, having generally elliptical perimeter 18, is symmetric about the minor axis of ellipse 14, and in this embodiment comprises an area removed from ellipse 14. Elliptical perimeter 18 is defined in part by major and minor radii $R_{ia}$ and $R_{ib}$ that in the embodiment are 10.2 mm and 1 mm, respectively.

While outer ellipse 14 is centered at a position 22 ($X_1$) equal to the outer radius width $R_{oa}$ (14.5 mm), inner ellipse 18 is off-center from the center of outer ellipse 14 at the position 24 ($X_2$)=18 mm. This offset results in a feed region width F of 7.8 mm and ground portion width G of 0.8 mm; a feed to ground width ratio of almost 10:1. The two ellipses are placed a height H=1.4 mm from the Y-axis that vertically bisects antenna 10. Thus, in essence the halves of each ellipse are separated from each other by a distance 2 H. Perimeters 14 and 18 are thus not exactly elliptical in the embodiment.

Discontinuity 16 is connected to the area of substrate surface 30 outside of ellipse 14 by the inclusion of feed region 40 that connects feed end 39 of discontinuity 16 to perimeter 14. Feed region 40 thus creates separated antenna element feed ends 41 and 42. The opposed ground end 38 of discontinuity 16 is spaced from perimeter 14 to define the antenna element ground portion 32.

The outer radius $R_{oa}$, approximates the frequency location of the antenna's first resonance. A reasonable approximation of $R_{oa}$ is treating the outer ellipse as a circle and set the circumference equal to the starting operating frequency. In other words:

$$2\pi R_{oa}=\lambda_{min}$$

Where $\lambda_{min}$ is the wavelength of the minimum operating frequency in free space. For the case of $f_{min}$=3.1 GHz, this gives an outer radius $R_{oa}$=15.4 mm, near the final $R_{oa}$=14.5 mm in the preferred embodiment. As further explained below, some of the other antenna parameters have an effect on the antenna's resonant frequency.

The outer radius height $R_{ob}$ can be expressed in terms of $R_{oa}$ as $$R_{ob}=\alpha R_{oa}$$

Where $\alpha$ is some positive, constant number. The change of the outer radius height can be seen by varying the ratio of $R_{ob}$ to $R_{oa}$, $$R_{ob}:R_{oa}=\alpha R_{oa}:R_{oa}=\alpha 1$$

The preferred embodiment features bulbous shaped antenna element feed ends 41, 42, FIG. 1A, to improve impedance performance. The signal is fed across feed ends 41 and 42. Preferably, but not necessarily, the two antenna element feed ends are identically shaped. Also, the antenna element feed ends can be designed to have other shapes, such as triangular, and still provide comparable performance. The antenna element feed ends should ideally taper out gradually as shown in FIG. 1A, rather than as a sharp flair or a concave form, for example, as such sharper shapes may give poorer impedance performance. However, the shape of the antenna element feed ends is not a limitation of the invention.

FIG. 1B shows a half loop embodiment 50 that is essentially one half of the antenna of FIG. 1A driven over a ground plane. Antenna 50 comprises a semi-elliptical version of antenna 10, FIG. 1A (in other words, one of the halves on either side of the bisecting y axis of antenna 10), oriented orthogonally to a ground plane. Antenna 50 comprises antenna element 12*a* that is a planar conductor on the surface of dielectric substrate 30*a*. Antenna element 12*a* is defined by outer half ellipse 14*a* and inner half ellipse 18*a*. Offset height H is still present. Antenna element ground portion 32*a* is electrically connected to ground plane 58, for example by soldering. Antenna element feed end 41*a* is fed by coaxial cable 52 having feed conductor 54 electrically connected to end 41*a*; the coax ground conductor 56 is electrically connected to ground plane 58.

FIG. 1C shows antenna 70 that is essentially the reverse of the antenna of FIG. 1A, in that inner ellipse 84 is a planar conductor, as is the region 80 of the substrate outside of large ellipse 82 and inside of substrate perimeter 81. Planar conductor region 80 is electrically connected to ground plane 96. The area inside of ellipse 82 and outside of ellipse 84 is substrate material without conductor thereon. Feed region 40*b* is conductor material that leads from center conductor 92 of coax cable 90 to inner elliptical conductor 84, and is not electrically coupled to ground plane 96. Ground conductor 94 of coax cable 90 is coupled to ground plane 96.

The exact shapes and dimensions are not required limitations of the invention. For example, the full loop antenna need not be symmetric about the y axis. One possibility of many would be to construct the antenna such that the outer radius of large ellipse 14 could have one value on one side of the minor axis, and another value on the other side of the minor axis. The inner ellipse could similarly be unbalanced about the y axis.

Figures 2A, 2B:
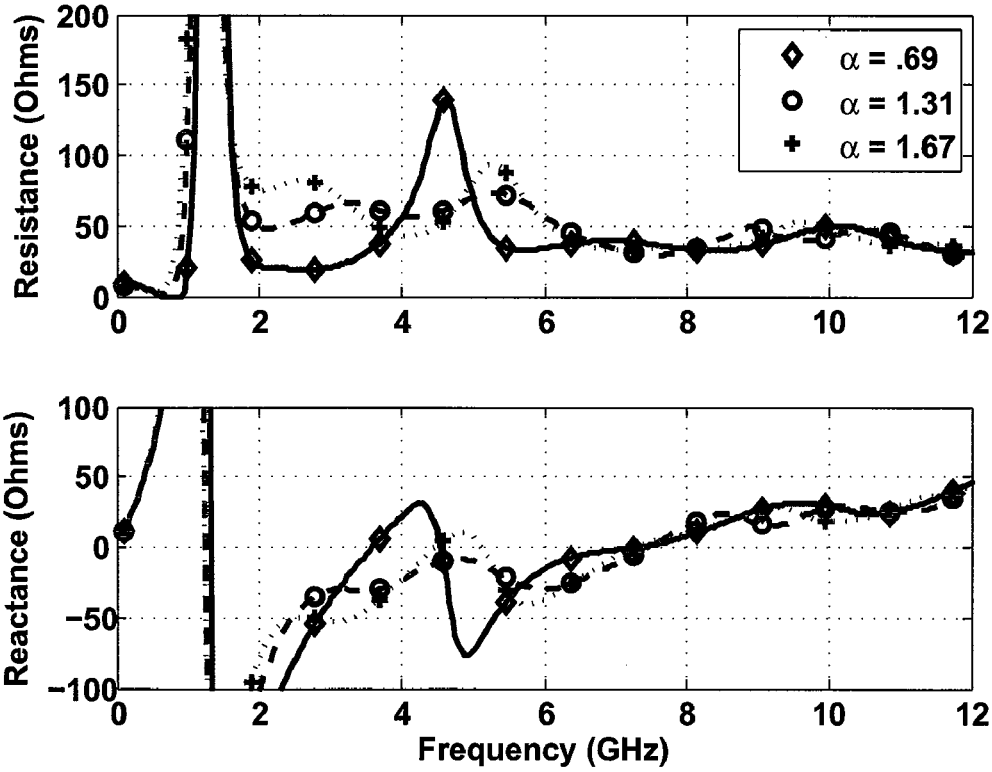
FIGS. 2A, 2B and 2C show the simulated resistance, reactance and voltage standing wave ratio (VSWR), respectively, of the antenna design of FIG. 1A with ratio $R_{ob}$: $R_{oa}$ varied and all other parameters kept constant.
Figure 2C:
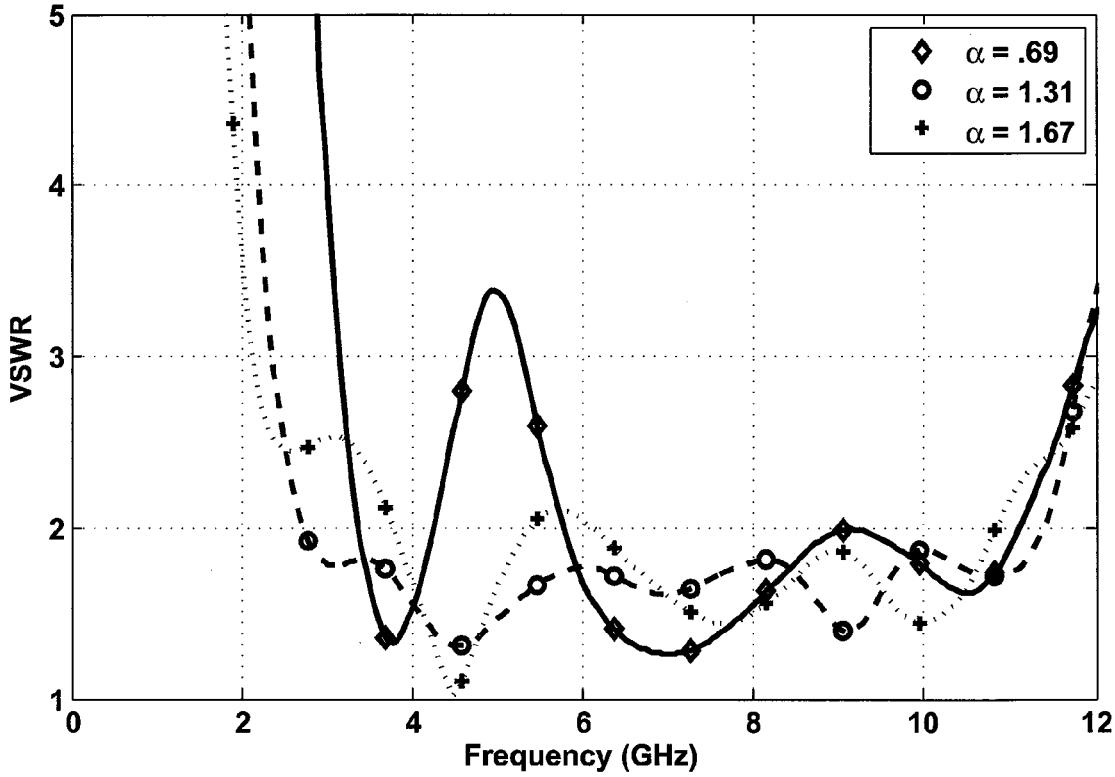

FIGS. 2A and 2B show the simulated resistance and reactance, respectively, of the antenna design of FIG. 1A with ratio $R_{ob}$: $R_{oa}$ varied and all other parameters kept constant ($R_{oa}$=14.5 mm, $R_{ia}$=10.2 mm, $R_{ib}$=1 mm, F=7.8 mm, G=0.8 mm, H=1.4 mm), while FIG. 2C shows the VSWR of the same antenna designs, with ratio $R_{ob}$: $R_{oa}$ varied and all other parameters kept constant.

FIGS. 2A and 2B illustrate resistance and reactance plots displaying the effect of varying a from the value of the preferred embodiment, which is $\alpha$=1.31. It can be seen that a greater than 1 offers better impedance stability than $\alpha$ less than 1. The second antiresonance is featured prominently in the $\alpha$=0.69 case at between 4 and 5 GHz. In general, increasing the outer height radius decreases the resonant frequency. At frequencies greater than 6 GHz the resistance and reactance for the three cases tend to follow similar trends. It is at the frequencies less than 6 GHz where the variations are more prominent. While an a greater than 1 will better suppress antiresonances than a value less than 1, if the value becomes too large, undesirable fluctuations enter into impedance performance, highlighted by fluctuations at around 5 to 6 GHz for the design with $\alpha$=1.67. For this one parameter, then, the alpha should be around 1 to 1.5; increasing the alpha much above this provides minor performance benefits, but can increase the antenna size to unacceptable proportions for many UWB applications that require small antenna size.

Figures 3A, 3B:
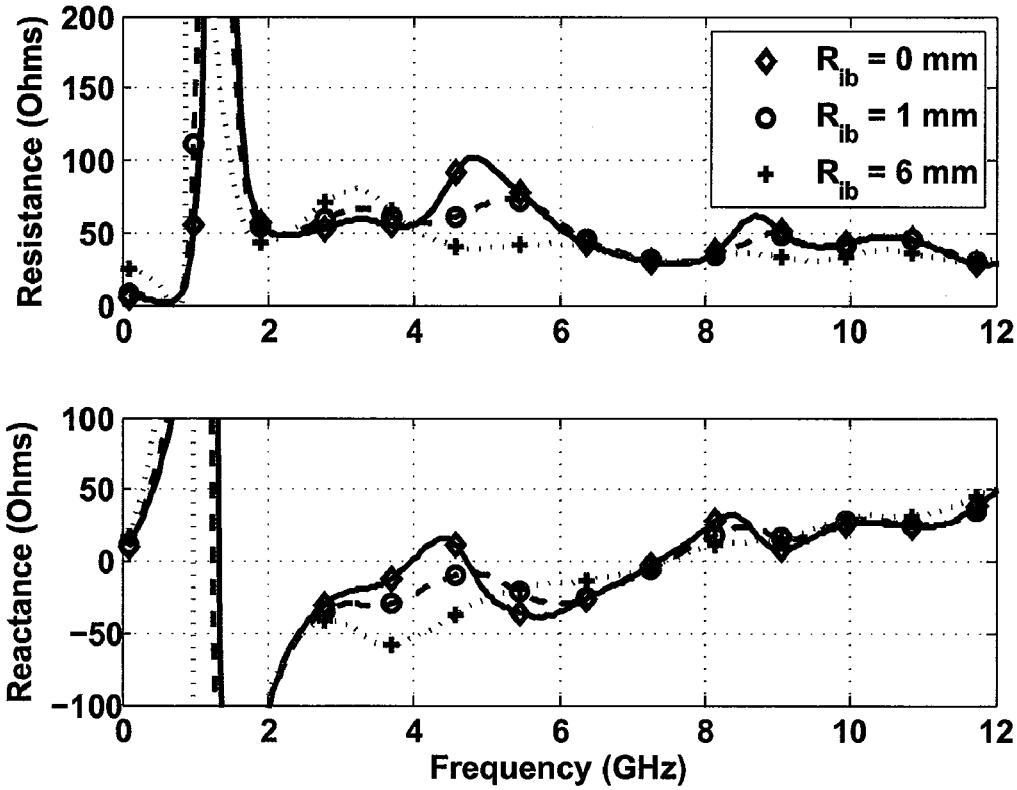
FIGS. 3A, 3B and 3C show the simulated resistance, reactance and VSWR, respectively, of the antenna design of FIG. 1A with inner ellipse height $R_{ib}$ varied and all other parameters kept constant.
Figure 3C:
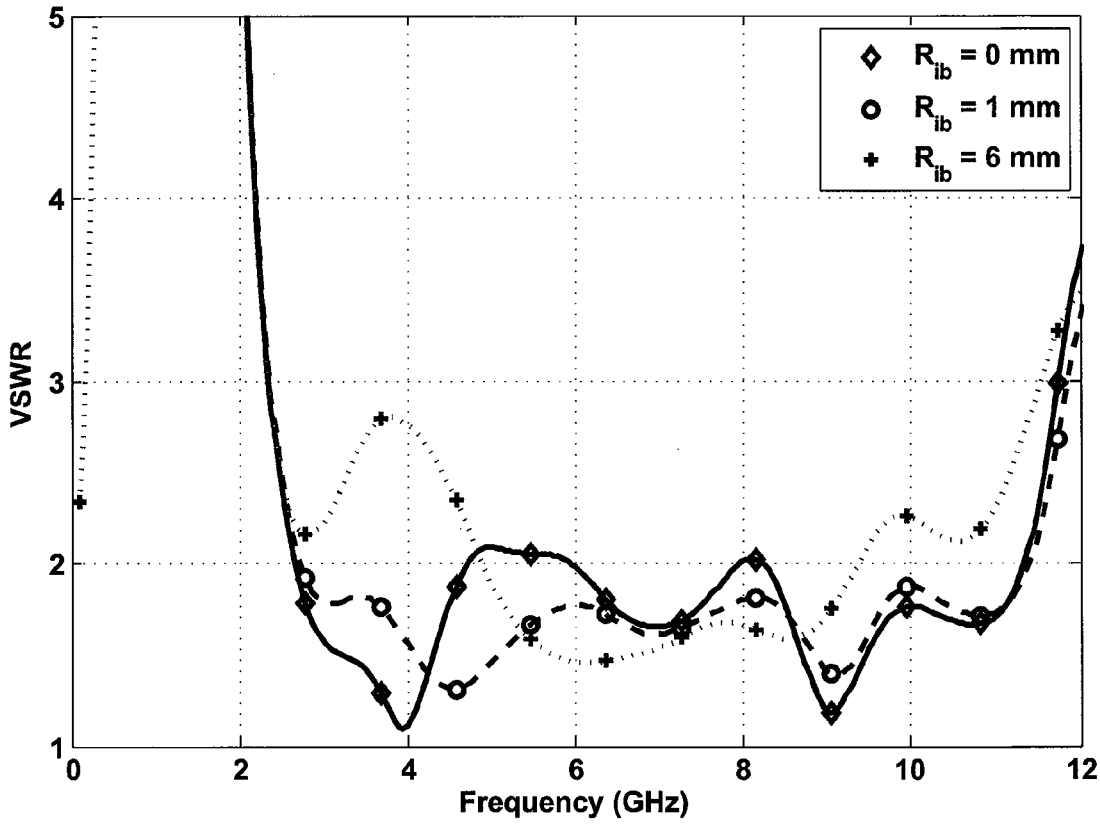

The simulated effect of inner radius height $R_{ib}$ is illustrated in the plots of FIGS. 3A-3C, which show the resistance, reactance and VSWR, respectively, of an inventive antenna with inner ellipse height $R_{ib}$ varied and all other parameters kept constant ($R_{oa}$=14.5 mm, $R_{ob}$=19 mm, $R_{ia}$=10.2 mm, F=7.8 mm, G=0.8 mm, H=1.4 mm). Cases were examined with a larger inner radius height, and no such height at all. The VSWR performance for three cases in FIG. 3C suggests a small inner radius height improves impedance stability to a point. Additionally, decreasing the inner radius height increases the resonant frequency position. Comparing the $R_{ib}$=1 mm with 6 mm, the reactance across the desired bandwidth tends closer to 0Ω when the height is reduced. However, if the height is reduced to a point where the inner ellipse is approximately nonexistent, undesired spikes in the resistance and reactance will occur. As was the case with varying the outer radius height, the resistance and reactance follow similar plot trends shown in previous figures near 7 GHz and above. A proper inner radius height value should be chosen based on its lower band performance, where more impedance variations are likely to occur, and is typically greater than zero.

Figures 4A, 4B:
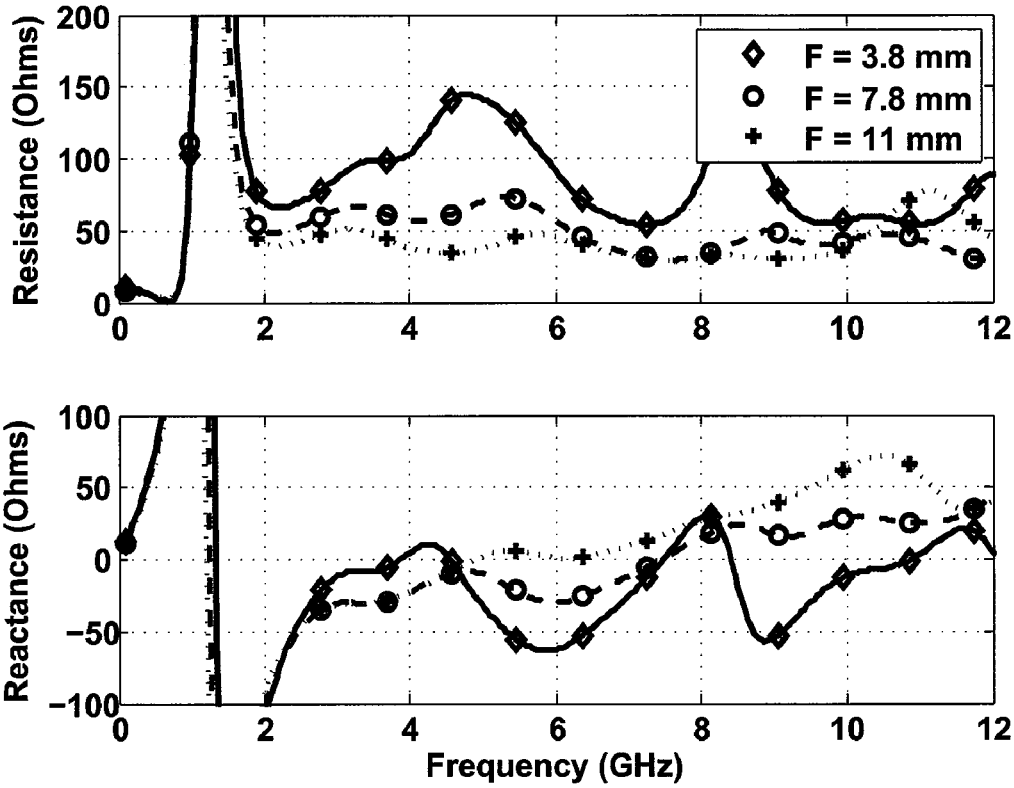
FIGS. 4A, 4B and 4C show the simulated resistance, reactance and VSWR, respectively, of the antenna of FIG. 1A for three cases of different feed width F, and all other parameters kept constant.
Figure 4C:
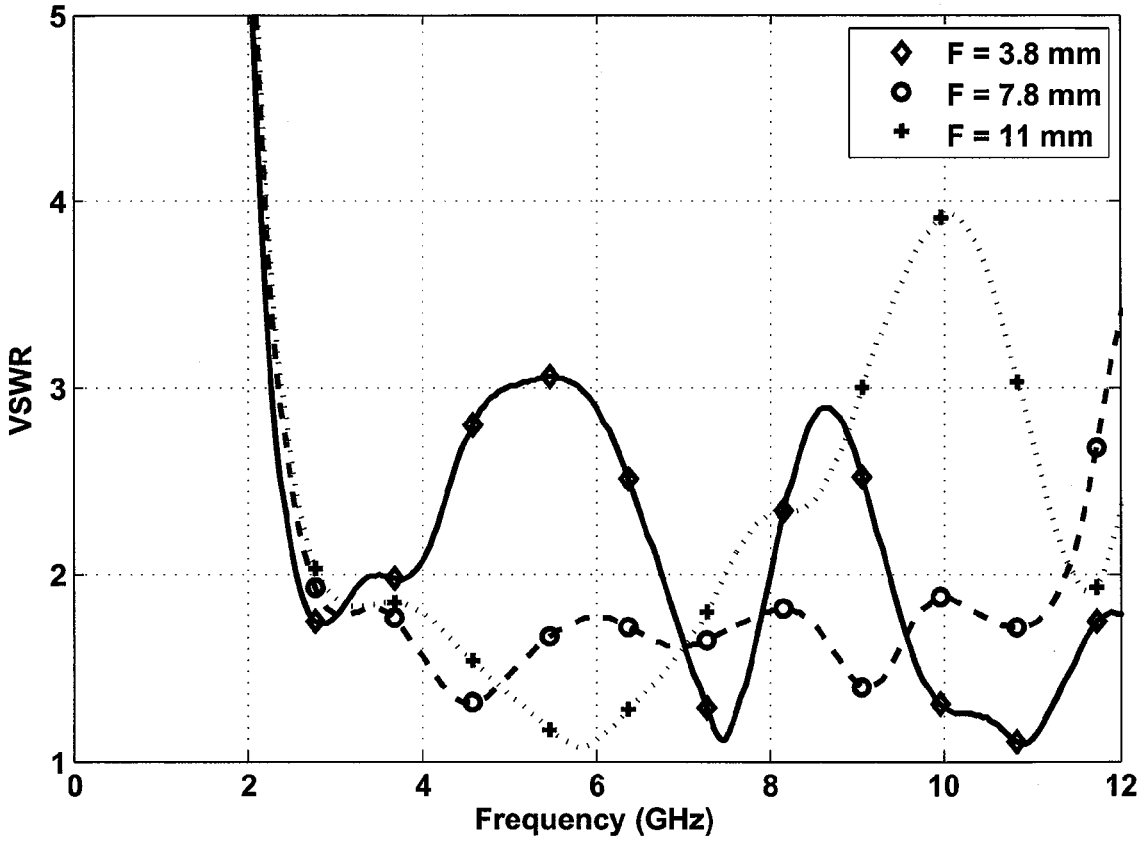

FIGS. 4A and 4B show the simulated resistance and reactance, respectively, of the antenna of FIG. 1A for three cases of different feed region width F, with all other parameters kept constant ($R_{oa}$=14.5 mm, $R_{ob}$=19 mm, $R_{ib}$=1 mm, G=0.8 mm, H=1.4 mm). For good bandwidth performance, the feed region width should be much larger than the ground width. For a narrow feed width the loop antiresonances are prominently featured, while the larger cases have a reasonably well-maintained resistance. If the feed width is made too large, though, the reactance can become too inductive out at the higher frequencies, highlighted with the 11 mm feed width example. Increasing the feed width lowers the resonant frequency and the impedance, more so the case at lower frequencies. The feed to ground width ratio is normally at least about 5. The actual feed width is dictated by the minimum ground width that can be achieved.

Figure 5A:
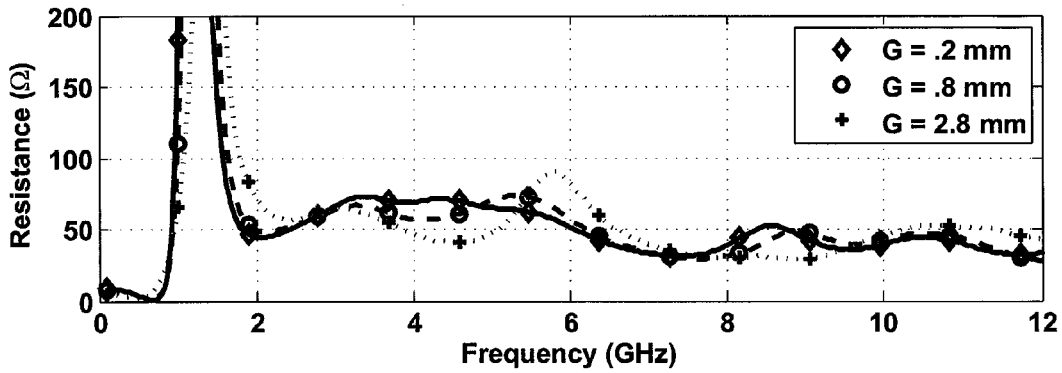
FIGS. 5A, 5B and 5C show the simulated resistance, reactance and VSWR, respectively, of the antenna of FIG. 1A with ground width G varied and all other parameters kept constant.
Figure 5B:
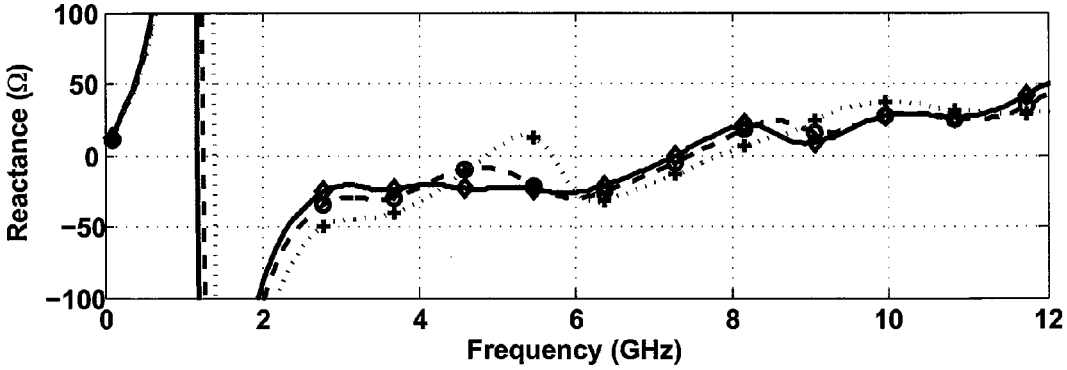
Figure 5C:
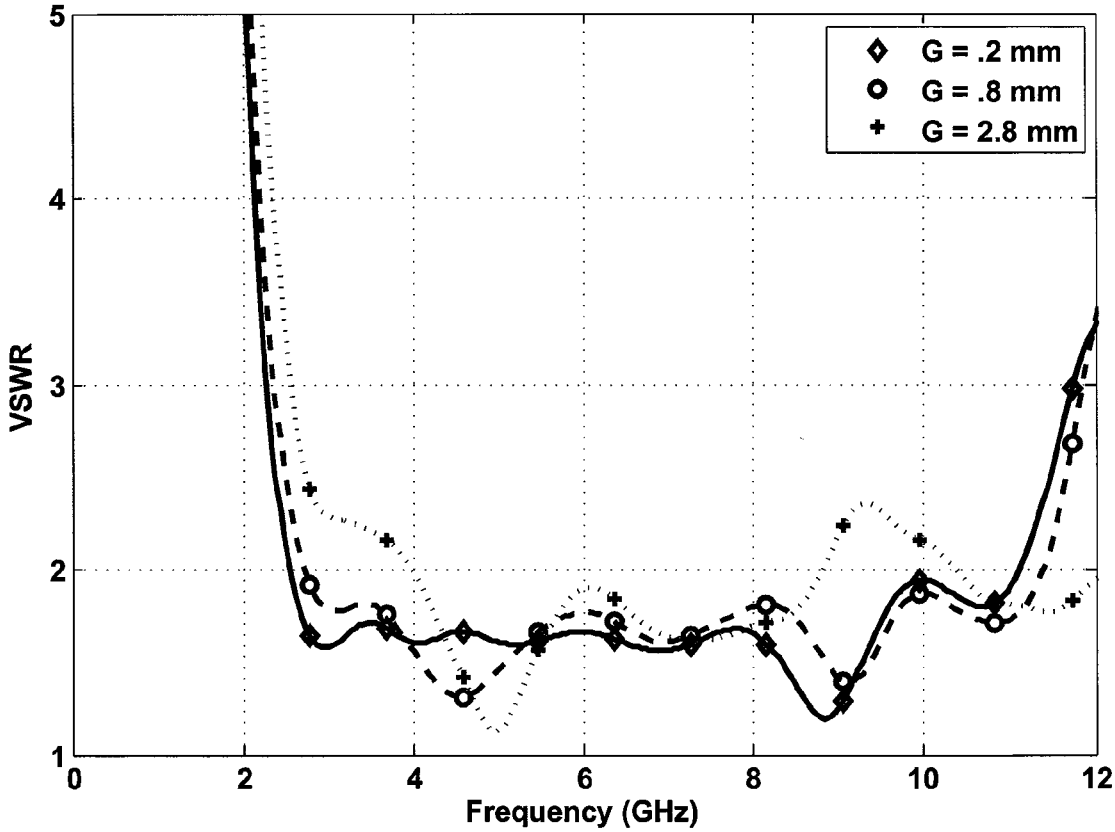

FIGS. 5A-5C illustrate the simulated resistance, reactance and VSWR, respectively, of the antenna of FIG. 1A with ground portion width G varied and all other parameters kept constant ($R_{oa}$=14.5 mm, $R_{ob}$=19 mm, $R_{ib}$=1 mm, F=7.8 mm, H=1.4 mm). The ground portion is the end of the antenna that is not fed. Note that to modify just the ground width, the inner radius width $R_{ia}$ and its center position $X_2$ are changed as well. It is apparent from the plots that a small ground width is preferable to a large one. This is confirmed by more stabilized resistance and reactance for the 0.2 and 0.8 mm ground width cases. For the 2.8 mm ground width case, the bandwidth is reduced due to the antenna being too capacitive at lower frequencies and having lower resistance and large inductance at the upper frequencies. The difference in impedance performance for the 0.2 and 0.8 mm cases is very little, suggesting that the ground width should be used as a fine-tuning parameter, and should typically be less than 1 mm.

Figure 6A:
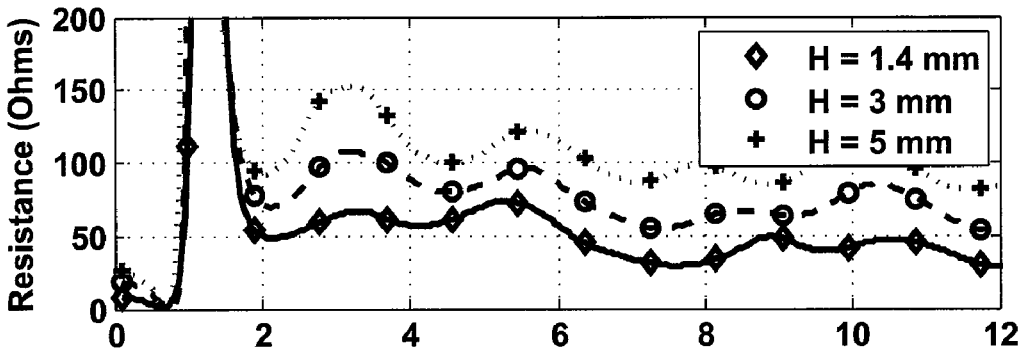
FIGS. 6A, 6B and 6C illustrate the simulated resistance, reactance and VSWR, respectively, of the antenna of FIG. 1A with height H varied and all other parameters kept constant.
Figure 6B:
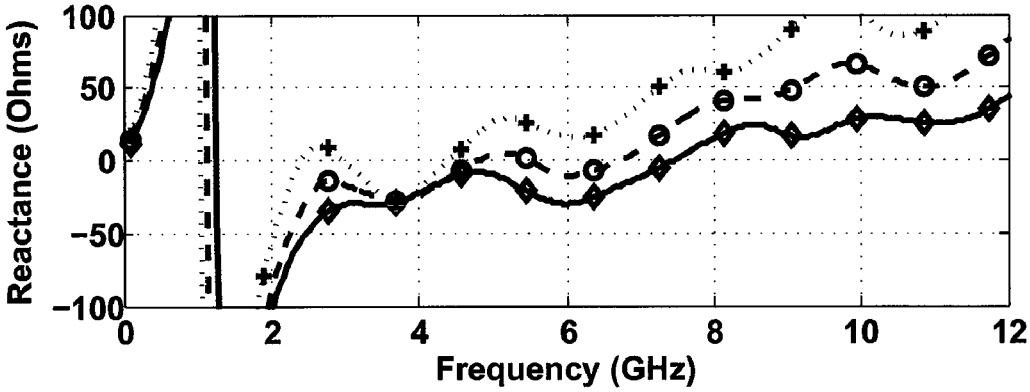
Figure 6C:
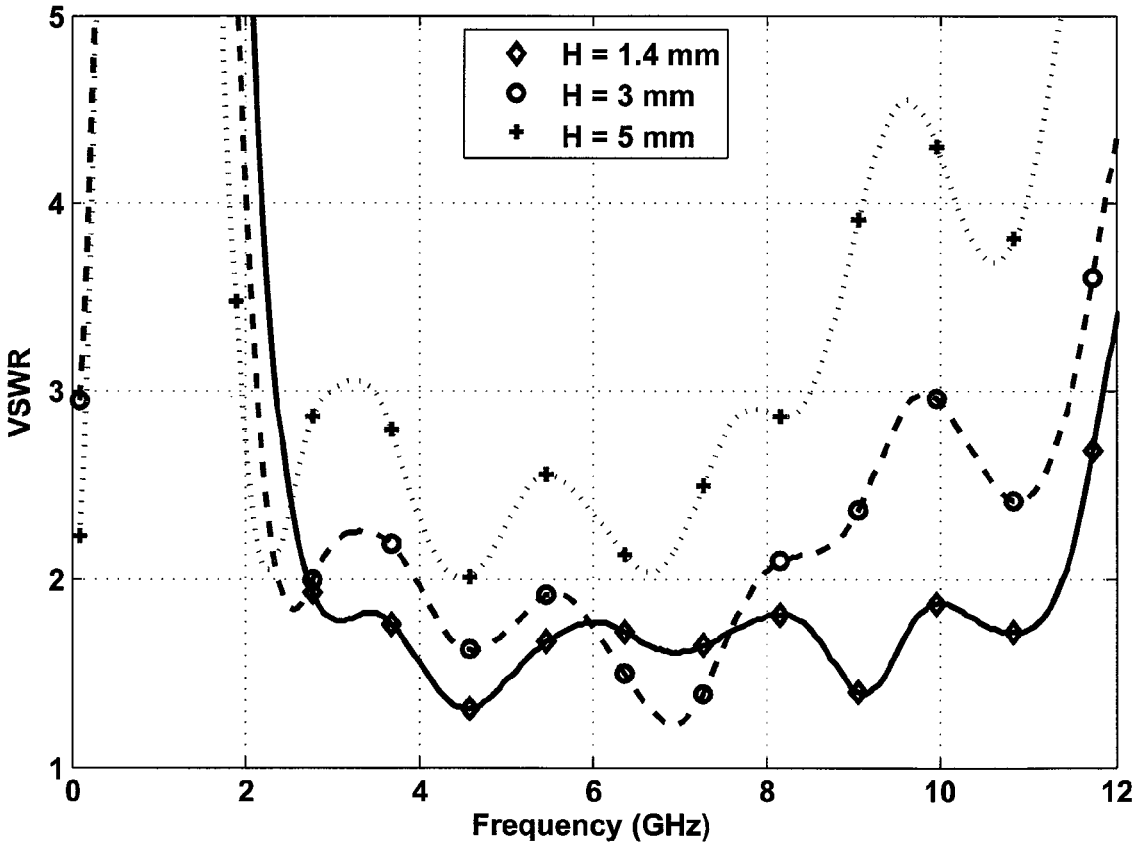

FIGS. 6A-6C illustrate the simulated resistance, reactance and VSWR, respectively, of the antenna of FIG. 1A with height H varied and all other parameters kept constant ($R_{oa}$=14.5 mm, $R_{ob}$=19 mm, $R_{ia}$=10.2 mm, $R_{ib}$=1 mm, F=7.8 mm, G=0.8 mm). The inclusion of extra height to the loop antenna has the general effect of shifting up or down the level of the resistance and reactance, shown by FIGS. 6A and B, respectively. When additional conductor is added at the feed and ground regions, the resistance and reactance move up and are scaled to some degree. Compared with the other parameters, changing the height does very little in smoothing out the impedance antiresonances, although the resonant frequency is decreased as height increases. When adding additional height to the device it should be as a tuning parameter, and should typically be greater than 1 mm.

Figure 7:
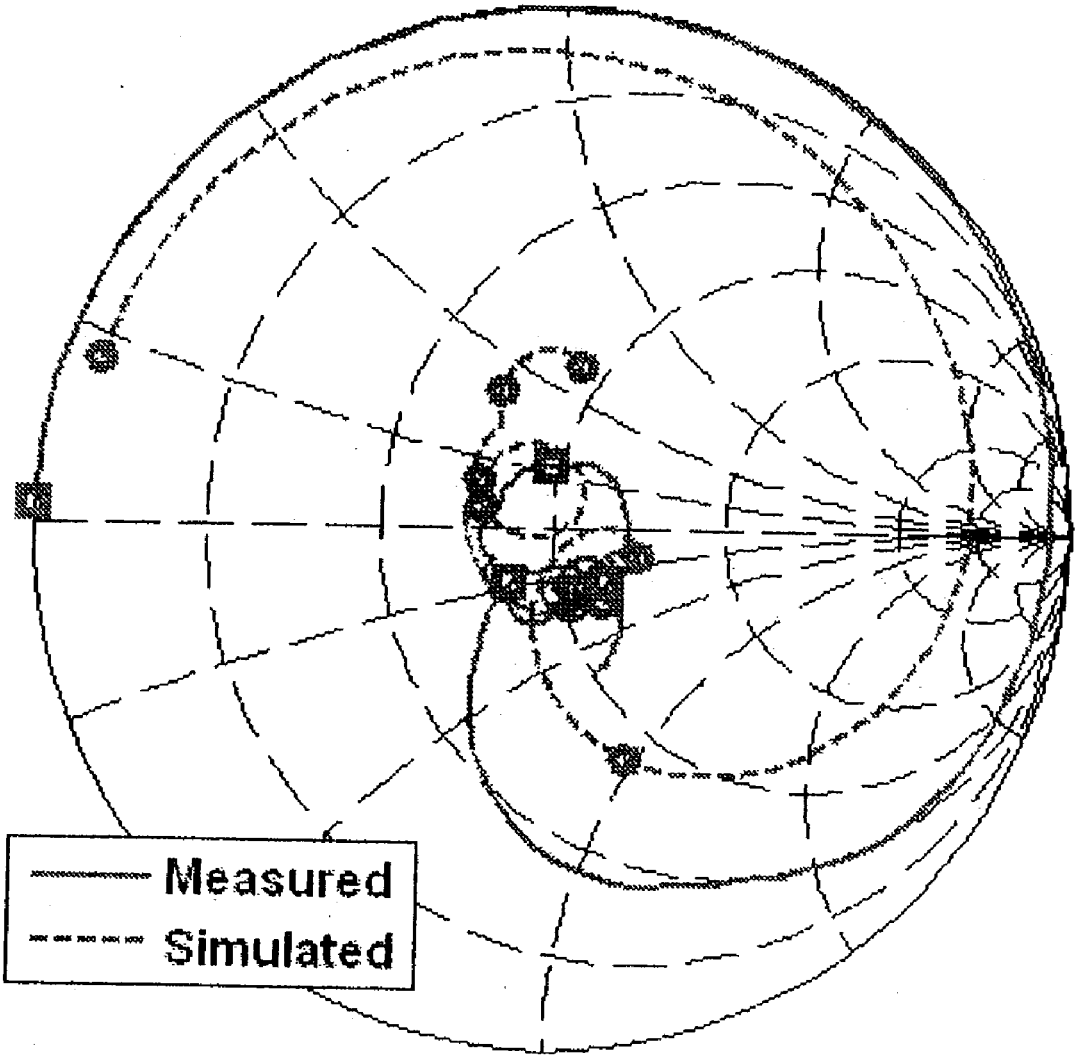
FIG. 7 is a Smith chart comparing results of a simulation of the preferred embodiment, and measurements from an antenna built according to the preferred embodiment.
Figure 10A:
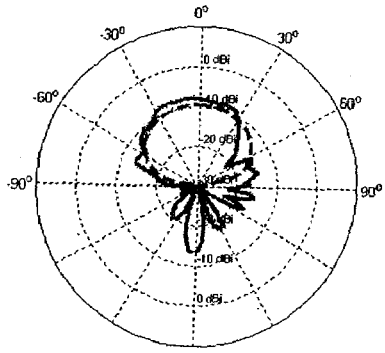
FIGS. 10A through 10L show samples of measured and simulated radiation patterns of the preferred embodiment of the inventive antenna in a half loop configuration.
Figure 10B:
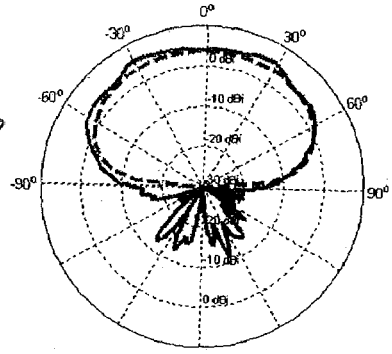
Figure 10C:
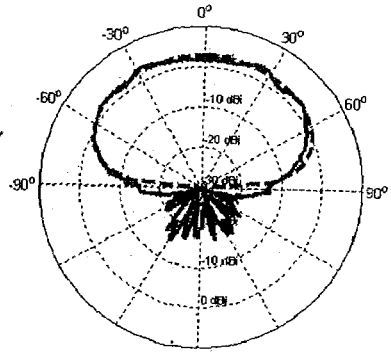
Figure 10D:
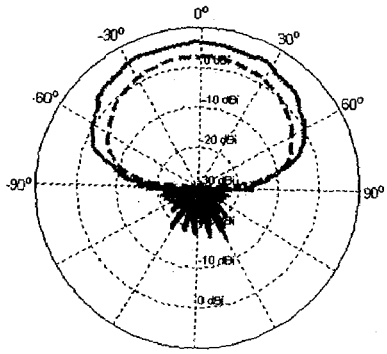
Figure 10E:
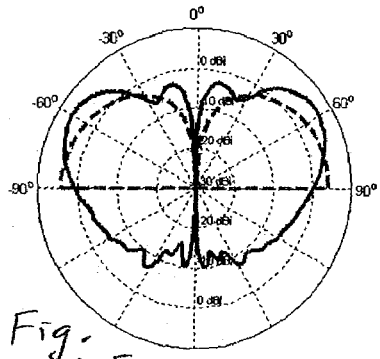
Figure 10F:
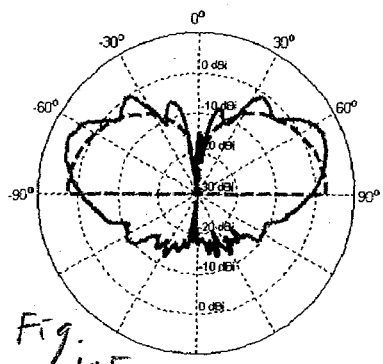
Figure 10G:
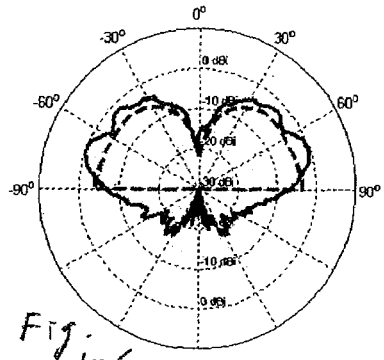
Figure 10H:
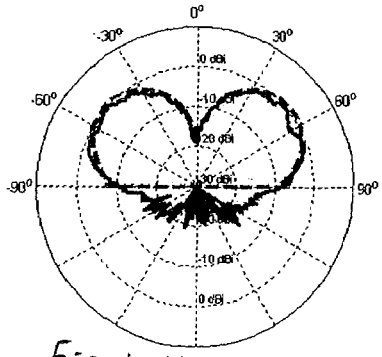
Figure 10I:
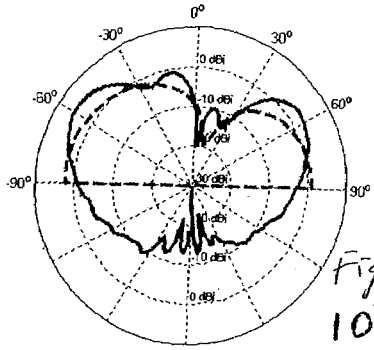
Figure 10J:
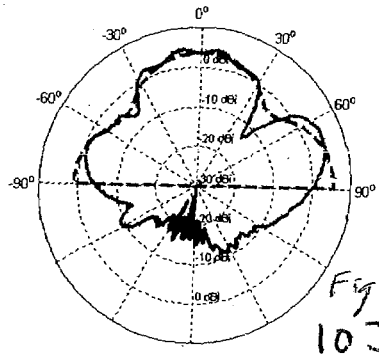
Figure 10K:
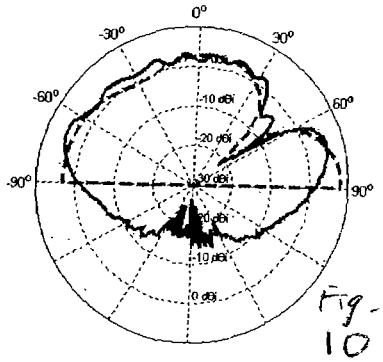
Figure 10L:
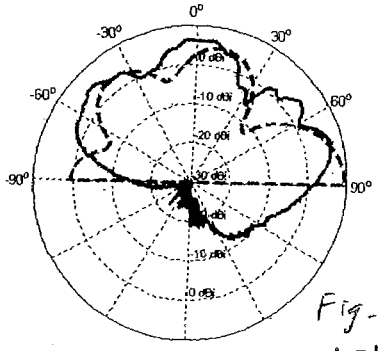

FIG. 7 is a Smith chart comparing results of a simulation of the preferred embodiment, and measurements from an actual antenna. This shows that there is good agreement with the measured and simulated data.

The inventive antenna is shown in FIG. 1A as comprising a full loop accomplished by a planar conductor on a substrate that supports the conductor. This substrate can be a dielectric, which itself has effects on antenna performance. For example, in addition to the substrate backing, the antenna offers comparable performance without the dielectric. The inclusion of substrate backing to the antenna causes the antenna to resonate at lower frequencies. The backing material's dielectric constant will also affect the amount of loading on the impedance. An increase in the dielectric constant reduces the overall input resistance. Also, if the backing extends beyond the perimeter of the conductor, the bandwidth at which the desirable VSWR<2 performance is achieved can be increased. This is especially important when trying to match to lower characteristic impedances, such as 50Ω. The substrate extensions, $S_{dx}$ and $S_{dy}$, FIG. 1A, can be determined through simulations. As a general rule, more dielectric can be sacrificed in $S_{dy}$ than in $S_{dx}$ and still maintain a VSWR<2 for the desired characteristic impedance. The substrate is not regulated to a rectangular design. It can also be shaped similar to the loop antenna and still offer reasonable performance, although the aforementioned excess substrate still applies. $S_{dx}$ and $S_{dy}$ are typically some value greater than zero.

The thickness of the substrate will also affect the amount of impedance loading on the antenna. As the substrate thickness increases, the resistance decreases. For example, if the thickness of the antenna's FR-4 backing was halved to 31 mils, the average input resistance would increase by about 7Ω.

It has been shown that the input impedance of the inventive antenna follows general trends that can be modified in order to obtain the best bandwidth usage for a particular application of the antenna. The resistance of the antenna tends to stay relatively constant throughout the entire bandwidth, except at the bandwidth edges, where the resistance has the potential to vary more. The reactance of the antenna tends to change somewhat linearly through the bandwidth; at the lower end of the band it stays capacitive until about midband, where the antenna becomes increasingly more inductive. This increase in reactance is unavoidable, so the aim should be to keep the antenna from being too capacitive at the lower end and too inductive at the upper end.

With reference to the data set forth herein, for design purposes, the approach for selecting the values for the various parameters can be accomplished as follows. First, determine initial values for $R_{oa}$ and α. These parameters will have the most effect on setting the resonant frequency and contribute a great deal to stabilizing the resistance and reactance. Next, select values of the inner ellipse radius width $R_{ia}$ and height $R_{ib}$. These parameters will set the feed and ground widths and provide additional impedance stabilization. A reasonable starting point for determining the feed and ground widths is to start with a feed to ground width ratio of around 5.5:1. Then, select a value for additional height H. The height is a fine-tuning parameter to position the resistance at the desired input level.

The bandwidth of the inventive antenna is generally larger when designed for larger characteristic impedances. This is due to the range of reactance values across the operating band having less effect on the antenna's matching to a load. For example, the preferred embodiment full loop antenna has a bandwidth of approximately 3.3 to 1. Another antenna designed for a 100Ω characteristic impedance was shown to exhibit a bandwidth of 5.5 to 1. This model was tested and measured with its results shown in FIG. 7.

Testing and Results

Several versions of the inventive antenna were constructed and tested, with and without a dielectric backing. Half-loops were constructed and soldered on perpendicular to 30×30 cm brass sheets to approximate an infinite ground plane. The antenna was fed by a 50Ω SMA connector and soldered to ground on the opposing end. The antenna's input impedance was measured on a network analyzer. Using image theory to complete the loop, the measured input impedance was doubled to compare with simulations.

The half loop antenna under test was designed for a 50Ω characteristic impedance, or a 100Ω characteristic impedance for the full loop. It was constructed on 30 mil Rogers Duroid 5880. The dimensions of the antenna were as follows: $R_{oa}$=16 mm, $R_{ob}$=18.6 mm, $R_{ia}$=12.1 mm, $R_{ib}$=1.1 mm, $X_2$=18.7 mm, H=2 mm, $S_{dx}$=$S_{dy}$=2 mm. The tested and simulated impedance measurements are shown in FIGS. 8A and 8B. The measured impedance shows relative agreement in trends with the simulated results. The biggest disparity between the two is in the reactance near 11 GHz. While the simulated reactance tends to be inductive, the measured reactance is capacitive.

FIGS. 9A, 9B and 9C show the measured and simulated gain of the preferred embodiment of the inventive antenna at $E_\theta$ (θ=0°, Φ=0°), $E_\Phi$ (θ=90°, Φ=0°) and $E_\Phi$ (θ=45°, Φ=90°), respectively, over the operating frequency. The gains in the E-field co- and cross-polarization show reasonable agreement in the gain over frequency. The H-field co-polarization does highlight the null angle; however the exact frequency where this occurs is disputed between measured and simulated data.

Samples of measured (solid lines) and simulated (dashed lines) radiation patterns of the preferred embodiment of the inventive antenna in a half loop configuration are shown in FIGS. 10A-10L for 3-10 GHz. The antenna's elevation $E_{\theta,\Phi}$ ($\theta$, $\Phi$=0°) (FIGS. 10A-10D) are symmetric as expected. The prominent side lobes in $E_{\Phi}$ (FIGS. 10E-10H) suggest that the antenna may be circularly polarized. The $E_{\theta}$ patterns (FIGS. 10A-10D) feature a prominent main lobe that increases with frequency. $E_{\Phi}$ patterns (FIGS. 10E-10H, and FIGS. 10I-10L) have prominent side lobes that decrease at higher frequencies.

The asymmetry of the antenna's feed and ground regions prevent any symmetry in the elevation $E_{\theta,\Phi}$ ($\theta$, $\Phi$=90°) patterns from occurring, FIGS. 10I-10L. In addition, these $E_{\Phi}$ patterns do not exhibit a typical shape through the entire bandwidth. A common feature is a pattern null whose angle increases as frequency increases. This null occurs on the ground region of the antenna. At higher frequencies the $E_{\Phi}$ patterns begins to assume a slightly symmetric pattern, although it features individual lobes rather than one prominent lobe. Unlike the $E_{\Phi}$ ($\theta$, $\Phi$=0°) cross-polarization patterns, the patterns for the $E_{\theta}$ ($\theta$, $\Phi$=90°) cross-polarization are weak and did not merit inclusion.

Although specific features of the invention are shown in some drawings and not others, this is for convenience only as some feature may be combined with any or all of the other features in accordance with the invention.

Other embodiments will occur to those skilled in the art and are within the following claims.

What is claimed is:

1. An ultra wideband loop antenna, comprising:

a planar antenna element defining either a generally semi-elliptical or generally elliptical perimeter having a major axis, a minor axis and a center, wherein the antenna element major axis is longer than its minor axis;

an elongated, contiguous discontinuity in the antenna element that is symmetric about and elongated in a direction parallel to the antenna element minor axis, and entirely located within the antenna element, in which the discontinuity defines either a generally semi-elliptical or generally elliptical perimeter having a major axis, a minor axis and a center, wherein the discontinuity major axis is longer than its minor axis;

in which the centers of the two ellipses are not coincident, and in which the major axis of the discontinuity is essentially colinear with or parallel to the minor axis of the antenna element, so as to define a feed end of the discontinuity located on the major axis of the discontinuity and spaced from one side of the antenna element perimeter by an element feed width, and so as to further define an opposed ground end of the discontinuity located on the discontinuity major axis and spaced from the opposing side of the antenna element perimeter by an element ground width, to define an antenna element ground portion, wherein the feed width is at least about five times greater than the ground width; and a feed region connecting the feed end of the discontinuity to the perimeter, to define one or two antenna element feed ends that are adjacent to the feed region.

2. The ultra wideband loop antenna of claim 1 in which the antenna element is a planar conductor.

3. The ultra wideband loop antenna of claim 2 in which the conductor is on the surface of a dielectric member.

4. The ultra wideband loop antenna of claim 3 in which the dielectric member is of greater area than the antenna element, and extends beyond the element perimeter around at least most of the perimeter.

5. The ultra wideband loop antenna of claim 1 in which one or more portions of the antenna element planar conductor are removed.

6. The ultra wideband loop antenna of claim 1 comprising a planar dielectric member with a planar conductor on its surface, and in which the antenna element comprises a gap in the conductor, and both the discontinuity in the antenna element and the feed region comprise portions of the planar conductor.

7. The ultra wideband loop antenna of claim 1 in which the major axis of the discontinuity is parallel to and spaced from the antenna element minor axis by an offset height.

8. The ultra wideband loop antenna of claim 7 in which the offset height is greater than the minor radius of the discontinuity ellipse.

9. The ultra wideband loop antenna of claim 1 in which the two halves of the antenna element that are defined by its minor axis are separated by an offset height, and in which the two halves of the discontinuity that are defined by its major axis are separated by the same offset height.

10. The ultra wideband loop antenna of claim 1 in which the antenna element has two feed ends that are essentially mirror images of one another.

11. The ultra wideband loop antenna of claim 10 in which the antenna element feed ends define a smoothly curved bulbous shape.

12. The ultra wideband loop antenna of claim 10 in which the antenna element feed ends define a gently tapered shape.

13. The ultra wideband loop antenna of claim 1 in which the antenna element major axis is less than about twice as long as its minor axis.

14. The ultra wideband loop antenna of claim 1 in which the antenna element defines an essentially fully elliptical perimeter to accomplish a full loop antenna.

15. The ultra wideband loop antenna of claim 1 in which the antenna element defines an essentially semi-elliptical perimeter, and further comprising a ground plane element oriented in a plane that is orthogonal to the antenna element, in which the antenna element ground portion is electrically coupled to the ground plane, to accomplish a half loop antenna.

16. An ultra wideband loop antenna, comprising:

a planar conductive antenna element defining an essentially elliptical perimeter having a major axis, a minor axis and a center, in which the antenna element major axis is longer than its minor axis but is less than about twice as long as its minor axis, and in which the two halves of the antenna element that are defined by its minor axis are separated by an offset height;

an elongated, contiguous gap in the antenna element that is symmetric about the antenna element minor axis, entirely located within the antenna element, and defines a generally elliptical perimeter having a major axis, a minor axis and a center, the major axis of the gap being parallel to and spaced from the antenna element minor axis by the offset height, the gap defining a gap feed end located on the minor axis and spaced from one side of the antenna element perimeter by an element feed width, and further defining an opposed gap ground end located on the minor axis and spaced from the opposing side of the antenna element perimeter by an element ground width, to define an antenna element ground portion, wherein the feed width is at least about five times greater than the ground width; and a feed region connecting the feed end of the gap to the perimeter, to define antenna element feed ends that are adjacent to the feed region, the antenna element feed ends being essentially mirror images of one another.

17. An ultra wideband loop antenna, comprising:

a planar conductive antenna element defining an essentially semi-elliptical perimeter having a major axis, a minor axis and a center, in which the antenna element major axis is longer than its minor axis but is less than about twice as long as its minor axis;

an elongated, contiguous gap in the antenna element that is symmetric about the antenna element minor axis, entirely located within the antenna element, and defines a generally semielliptical perimeter having a major axis, a minor axis and a center, the major axis of the gap being parallel to and spaced from the antenna element minor axis by an offset height, the gap defining a gap feed end located on the minor axis and spaced from one side of the antenna element perimeter by an element feed width, and further defining an opposed gap ground end located on the minor axis and spaced from the opposing side of the antenna element perimeter by an element ground width, to define an antenna element ground portion, wherein the feed width is at least about five times greater than the ground width;

a feed region connecting the feed end of the gap to the perimeter, to define an antenna element feed end that is adjacent to the feed region; and a ground plane element oriented in a plane that is orthogonal to the antenna element, in which the antenna element ground portion is electrically coupled to the ground plane.

* * * * *